US008833042B2

(12) United States Patent
Wochner et al.

(10) Patent No.: US 8,833,042 B2
(45) Date of Patent: Sep. 16, 2014

(54) METHOD AND DEVICE FOR PACKAGING POLYCRYSTALLINE BULK SILICON

(75) Inventors: Hanns Wochner, Burghausen (DE); Bruno Lichtenegger, Emmerting (DE); Reiner Pech, Neuötting (DE)

(73) Assignee: Wacker Chemie AG, Munich (DE)

( * ) Notice: Subject to any disclaimer, the term of this patent is extended or adjusted under 35 U.S.C. 154(b) by 727 days.

(21) Appl. No.: 12/664,418

(22) PCT Filed: Jun. 5, 2008

(86) PCT No.: PCT/EP2008/056989

§ 371 (c)(1),
(2), (4) Date: Dec. 14, 2009

(87) PCT Pub. No.: WO2008/151978

PCT Pub. Date: Dec. 18, 2008

(65) Prior Publication Data

US 2010/0154357 A1 Jun. 24, 2010

(30) Foreign Application Priority Data

Jun. 13, 2007 (DE) ..... 10 2007 027 110

(51) Int. Cl.

| | |
|---|---|
| ***B65B 55/20*** | (2006.01) |
| ***B65B 55/24*** | (2006.01) |
| ***B65B 29/00*** | (2006.01) |
| ***B65B 25/00*** | (2006.01) |
| ***B65B 39/12*** | (2006.01) |
| *B65B 1/06* | (2006.01) |

(52) U.S. Cl.

CPC ..... *B65B 25/00* (2013.01); *B65B 29/00* (2013.01); *B65B 55/24* (2013.01); *B65B 39/12* (2013.01)

USPC ..... 53/434; 53/467; 53/473; 53/239; 53/241; 53/284.7; 53/512

(58) Field of Classification Search

USPC ..... 53/434, 467, 473, 475, 239, 241, 248, 53/469, 284.7, 512, 502, 459, 570, 255; 141/10, 166, 313–317

See application file for complete search history.

(56) References Cited

U.S. PATENT DOCUMENTS

| | | | | | |
|---|---|---|---|---|---|
| 1,546,360 | A | * | 7/1925 | Bates | 53/451 |
| 3,265,098 | A | * | 8/1966 | O'Neal et al. | 141/5 |
| 3,675,367 | A | * | 7/1972 | Amburn | 47/1.3 |
| 3,707,172 | A | * | 12/1972 | Obara | 141/59 |
| 3,777,447 | A | * | 12/1973 | Herbine et al. | 53/467 |
| 3,789,888 | A | * | 2/1974 | James et al. | 141/4 |
| 3,925,963 | A | * | 12/1975 | Greenawalt et al. | 53/552 |
| 3,948,019 | A | * | 4/1976 | Doring et al. | 53/505 |
| 3,968,771 | A | * | 7/1976 | Walgenbach et al. | 118/303 |
| 4,049,028 | A | * | 9/1977 | Harris et al. | 141/10 |
| 4,109,792 | A | * | 8/1978 | Greenawalt et al. | 206/525 |
| 4,348,852 | A | * | 9/1982 | Clancy | 53/469 |
| 4,525,336 | A | * | 6/1985 | Griesshammer et al. | 423/348 |
| 4,586,320 | A | * | 5/1986 | Takai et al. | 53/512 |
| 4,681,228 | A | * | 7/1987 | Kerry et al. | 206/484 |
| 4,964,259 | A | * | 10/1990 | Ylvisaker et al. | 53/433 |
| 5,067,989 | A | | 11/1991 | Yokota et al. | |
| 5,109,893 | A | * | 5/1992 | Derby | 141/67 |
| 5,443,102 | A | * | 8/1995 | Svendsen | 141/10 |
| 5,445,679 | A | * | 8/1995 | Hansen et al. | 134/1 |
| 5,687,551 | A | * | 11/1997 | Mustain et al. | 53/468 |
| 5,711,136 | A | * | 1/1998 | Carcano | 53/434 |
| 5,753,567 | A | * | 5/1998 | Banan et al. | 438/720 |
| 5,855,232 | A | * | 1/1999 | Oda et al. | 141/83 |
| 5,961,000 | A | * | 10/1999 | Sanfilippo et al. | 222/152 |
| 6,056,027 | A | * | 5/2000 | Patterson | 141/370 |
| 6,309,467 | B1 | | 10/2001 | Wochner et al. | |
| 6,405,512 | B1 | * | 6/2002 | Tornberg | 53/428 |
| 6,470,921 | B1 | * | 10/2002 | McGregor | 141/12 |
| 6,589,332 | B1 | * | 7/2003 | Holder et al. | 117/14 |
| 6,631,605 | B1 | * | 10/2003 | Quintin et al. | 53/451 |
| 6,851,911 | B2 | * | 2/2005 | Lhoest | 414/299 |
| 6,951,090 | B2 | * | 10/2005 | Kondo et al. | 53/551 |
| 7,013,620 | B2 | | 3/2006 | Hoelzlwimmer et al. | |
| 7,544,114 | B2 | * | 6/2009 | Orlhac | 451/28 |
| 7,784,370 | B2 | * | 8/2010 | Matsusaka et al. | 73/866 |
| 2002/0129868 | A1 | * | 9/2002 | Ikemoto et al. | 141/114 |
| 2002/0144642 | A1 | | 10/2002 | Sreedharamurthy et al. | |
| 2003/0159647 | A1 | * | 8/2003 | Arvidson et al. | 117/30 |
| 2004/0182469 | A1 | | 9/2004 | Concetti | |
| 2005/0034430 | A1 | | 2/2005 | Holzlwimmer et al. | |
| 2005/0132670 | A1 | * | 6/2005 | Curran | 53/459 |
| 2005/0279277 | A1 | * | 12/2005 | Holder et al. | 117/19 |
| 2006/0213153 | A1 | * | 9/2006 | Sanfilippo et al. | 53/511 |
| 2006/0283001 | A1 | * | 12/2006 | Bussey et al. | 29/429 |
| 2007/0040056 | A1 | | 2/2007 | Weidhaus | |
| 2010/0001106 | A1 | * | 1/2010 | Schaefer et al. | 241/25 |
| 2011/0036868 | A1 | * | 2/2011 | Gotoh et al. | 222/185.1 |
| 2011/0204083 | A1 | * | 8/2011 | Meckstroth | 222/1 |

FOREIGN PATENT DOCUMENTS

| | | | |
|---|---|---|---|
| DE | 20206759 | U1 | 9/2002 |
| EP | 0905796 | B1 | 4/2002 |
| EP | 1334907 | A1 | 8/2003 |
| EP | 1334907 | B1 | 4/2004 |

(Continued)

*Primary Examiner* — Paul R Durand

*Assistant Examiner* — Gloria R Weeks

(74) *Attorney, Agent, or Firm* — Brooks Kushman P.C.

(57) ABSTRACT

An automated filling system for introducing crushed polysilicon fragments into shipping bags without significant contamination positions a freely suspended energy absorber into a freely suspended bag of non-contaminating material prior to filling, and following filling, the energy absorber is removed, and the bag is sealed. The system can replace manual packaging which has been required for semiconductor applications.

16 Claims, No Drawings

(56) References Cited

FOREIGN PATENT DOCUMENTS

| | | | |
|---|---|---|---|
| EP | 1459981 | A1 | 9/2004 |
| JP | 3080193 | A | 4/1991 |
| JP | 05-094187 | | 4/1993 |
| JP | 8026486 | A | 1/1996 |
| JP | 8104311 | A | 4/1996 |
| JP | 10211908 | A | 8/1998 |
| JP | 2003237722 | A | 8/2003 |
| JP | 2004521056 | T2 | 7/2004 |
| JP | 2007051061 | A | 3/2007 |

* cited by examiner

METHOD AND DEVICE FOR PACKAGING POLYCRYSTALLINE BULK SILICON

CROSS-REFERENCE TO RELATED APPLICATIONS

This application is the U.S. National Phase of PCT Appln. No. PCT/EP2008/056989 filed Jun. 5, 2008 which claims priority to German application DE 10 2007 027 110.9 filed Jun. 13, 2007.

BACKGROUND OF THE INVENTION

1. Field of the Invention

The invention relates to a method and a device for packaging crushed polycrystalline silicon material.

2. Description of the Related Art

Polycrystalline silicon (polysilicon) is usually deposited from trichlorosilane by means of the Siemens process and then, for applications in the solar industry, usually undergoes low-contamination comminution and, for applications in the semiconductor industry, comminution and subsequent partial cleaning. Depending on the planned application, the crushed polysilicon material obtained in this way may contain the maximum contaminants of metal elements stated in Table 1 after packaging.

TABLE 1

Maximum content of metal contaminants
Figures given in pptw

| Material | Fe | Cr | Ni | Na | Zn | Al | Cu | Mo | Ti | W | K | Co | Mn | Ca | Mg | V |
|---|---|---|---|---|---|---|---|---|---|---|---|---|---|---|---|---|
| A | <50 | <20 | <10 | <100 | <20 | <30 | <10 | <10 | <100 | <20 | <100 | <5 | <20 | <100 | <100 | <5 |
| B | <1000 | <100 | <50 | <1000 | <200 | <300 | <20 | <50 | <200 | <1000 | <200 | <100 | <20 | <1000 | <500 | <20 |

A: Crushed polysilicon material for the electronics industry (after low-contamination comminution, cleaning and packaging)
B: Crushed polysilicon material for the solar industry (after low-contamination comminution and packaging)

Crushed polysilicon material for the electronics industry usually has to be packaged in 5 kg bags with a weight tolerance of +/−30 g, while crushed polysilicon material for the solar industry is usually supplied in bags with an initial weight of 10 kg and a weight tolerance of +/−100 g.

Commercially available horizontal or vertical bag forming, filling and sealing machines, as are used in the pharmaceutical industry for packaging medicaments or in the food industry for packaging tea and coffee, are only suitable to a certain extent for the packaging of crushed polysilicon material, a bulk material with sharp edges that is not free-flowing and has a weight of individual Si fragments of up to 10,000 g, since this material perforates conventional plastic bags during filling and, in the worst case, completely destroys them. Moreover, it is not possible with these devices to meet the purity requirements that are required of the crushed polysilicon material in the aforementioned applications, since the composite films used lead to contaminants above the limit values stated in Table 1 on account of chemical additives, and are therefore not suitable for the packaging of crushed polysilicon material.

EP A 133 4907 (US 2005-0034430) discloses a method and a device that are intended to make it possible for high-purity crushed polysilicon material to be portioned, filled and packaged at low cost and in a fully automated manner. This device comprises a means for portioning the crushed polysilicon material, a filling device, a plastic bag, and a welding device for the plastic bag filled with crushed polysilicon material. In this filling device, the plastic bag is formed from a high-purity film of plastic by means of a filling and bag-forming tube. This procedure entails several disadvantages.

First, during the forming of the plastic bag, the plastic surface that forms the inner side of the plastic bag comes into contact with the metal surface of the filling and bag-forming tube. This leads to undesired metal contaminations of the inner bag surface. Therefore, an iron level of <50 pptw for the packaged polysilicon cannot be achieved with this device. Second, during filling of the bag with crushed polysilicon material, contact with the inner side of the filling and bag-forming tube causes contamination of the crushed polysilicon material. Third, the design-dependent high falling height of the crushed polysilicon material, or the abrasion caused by the sharp-edged crushed polysilicon material, has the effect that the plastic coating is so worn away after approximately 100 tonnes of packaged material that parts of the filling and bag-forming tube have to be exchanged. Fourth, as a result of the high falling height during filling, the crushed polysilicon material often perforates the bag wall. Fifth, an initial weight of the crushed polysilicon material within the stated tolerance is scarcely possible by means of this device.

The automatic portioning for this purpose is laborious, since the crushed polysilicon material, which generally occurs with a weight of the individual fragments of between 0.1 and 10.000 g, has to be separated into a number of product flows of differently sized fragments, which then have to be mixed together again in a specific manner ahead of the weighing balance, in order to be able to maintain the required accuracy of weight. Moreover, because of the design-dependent high falling height, this method leads to the formation of slivers and dust, and consequently to unacceptable contamination and post-comminution of the crushed polysilicon material.

On account of these disadvantages of the automatic packaging machine, labor-intensive manual packaging of the cleaned crushed polysilicon materials in a clean room of class 100 continues to be common practice for high-grade polysilicon. In the process, cleaned crushed polysilicon materials, which no longer have any metal contaminants on their surface, are taken from a process bowl, in which cleaning takes place, by someone wearing sterilized gloves, for example sterilized textile, PU or PE gloves, and are introduced into a PE double bag. Owing to glove abrasion and the general handling performed by the personnel, the content of plastic and metal particles on the crushed polysilicon material increases when it is touched with gloves. Measurements have shown that the metal surface content for the individual elements in the case of manual packaging increases on average by the values stated in Table 2:

TABLE 2

| Increase in contamination of crushed polysilicon material in the case of manual packaging Figures given in pptw | | | | | | | | | | | | | | | |
|---|---|---|---|---|---|---|---|---|---|---|---|---|---|---|---|
| Fe | Cr | Ni | Na | Zn | Al | Cu | Mo | Ti | W | K | Co | Mn | Ca | Mg | V |
| 15 | 2 | 3 | 15 | 10 | 4 | 3 | 0 | 16 | 0 | 12 | 0 | 0 | 19 | 3 | 0 |

This shows that it is only by such laborious, time-intensive manual packaging of crushed polysilicon material that the purity requirements with respect to the metal surface values for the electronics industry are met (Table 1).

SUMMARY OF THE INVENTION

The object of the invention is to provide a method which makes low-cost, low-contamination packaging of sharp-edged crushed polysilicon material possible.

These and other objects are achieved by a method in which polycrystalline silicon is filled by means of a filling device into a freely suspended, completely formed bag, and the filled bag is subsequently closed, characterized in that the bag consists of high-purity plastic with a wall thickness of from 10 to 1000 μm.

DETAILED DESCRIPTION OF THE PREFERRED EMBODIMENTS

The filling device preferably comprises a freely suspended energy absorber of a nonmetallic low-contamination material, which is introduced into the plastic bag before filling with the polycrystalline silicon. The polycrystalline silicon is filled into the plastic bag by way of the energy absorber. The freely suspended energy absorber is subsequently removed from the plastic bag filled with polycrystalline silicon, and the plastic bag is closed.

The method is suitable for packaging both crushed polysilicon material for solar applications and crushed polysilicon material for the electronics industry. It is also suitable for the packaging of polysilicon granules, since with such material there is also a reduction in the contamination of the granules by abraded plastic during the filling of the PE bags. The method and the device according to the invention are suitable in particular for packaging sharp-edged polycrystalline silicon fragments up to a weight of 10 kg. The advantages are obtained in particular when fragments with an average weight greater than 80 g are present.

The method according to the invention makes it possible when packaging polysilicon for the solar industry with reduced contamination of the crushed polysilicon material, to obtain a level of productivity equivalent to that of a packaging machine according to EP 1334907. In the case of packaging polysilicon for the electronics industry, which has not previously been packaged with a packaging machine according to EP 1334907 on account of the stringent purity requirements, but still has to be manually packaged, the method according to the invention makes it possible to increase the productivity to four times that of manual packaging, while at the same time the quality remains the same with respect to contamination of the silicon and the perforation rate of the bags.

For the purposes of the invention, a low-contamination material is to be understood as meaning a material which, after contact with the polysilicon, contaminates the surface of the polysilicon higher than stated in Table 2, at most as follows: metals by a factor of 10, preferably a factor of 5, more preferably a factor of less than or equal to 1, dopants boron, phosphorus, arsenic, antimony by less than 10 ppta, preferably less than 2 ppta; and carbon less than 300 pptw.

The contamination is measured by the difference obtained by subtracting "contamination of a piece of Si before contact with the material" from "contamination of the piece of Si after contact with the material". The high-purity plastic is preferably polyethylene (PE), polyethylene terephthalate (PET) or polypropylene (PP).

High-purity is preferably to be understood as meaning that the plastic does not contain any additional antistatic agents, for example $SiO_2$, or slip agents, such as long-chain organic compounds (for example Erucamide), in the bulk and on the surface.

When filling with crushed polysilicon material, the plastic bag is preferably held by means of at least two tong-like grippers and fed by means of these grippers to a closing device, preferably a welding device. The 10 to 1000 μm thick PE bag is preferably taken from a storage container and opened by means of the grippers before filling. The gripping arm in this case preferably grips the PE bags at the edge. As a result, unlike in the case of the bag forming, filling and sealing machine according to EP 133 4907 B 1, there is no contamination of the inner surface of the PE bag because of the absence of a baffle plate. Alternatively, as described in the utility model DE 202 06 759 U1, the plastic bag may be picked up from a belt by means of a vacuum sucker and introduced individually into the packaging device.

The freely suspended, flexible energy absorber of a nonmetallic low-contamination material preferably has the form of a funnel or hollow body, for example a tube or a square tube, or a hollow body that is partly split open laterally, parallel to the longitudinal direction, or a slatted screen or a number of elongate panels, strands or rods. It preferably consists of textile material (for example Gore-Tex®—PTFE fabric or polyester/polyamide fabric), plastics (for example PE, PP, PA, or copolymers of these plastics). With particular preference, it consists of a rubber-elastic plastic, for example PU, unvulcanized or vulcanized rubber or ethylene vinyl acetate (EVA), with a Shore A hardness of between 30 A and 120 A, preferably 70 A.

The closing of the plastic bag may take place, for example, by means of welding, adhesive bonding or a form fit. It preferably takes place by means of welding.

The filling device preferably comprises a filling unit and the freely suspended energy absorber, which is connected to the filling unit. The freely suspended energy absorber preferably has the form of a freely suspended movable flexible tube or one of the other forms mentioned, which for the sake of simplicity are to be understood hereafter as subsumed by the term tube. The movable flexible tube is introduced into the bag and the crushed polysilicon material is introduced into the bag by way of the filling unit and the flexible tube. The filling unit is preferably a funnel, a conveying channel or a chute, which is lined with a low-contamination material or consists of a low-contamination material. After filling of the bag, the movable flexible tube is withdrawn from the bag and the bag is subsequently welded.

The freely suspended energy absorber absorbs a large part of the kinetic energy of the crushed polysilicon material falling into the bag. It protects the walls of the plastic bag from contact with the sharp-edged polycrystalline silicon and prevents perforation of the plastic bag. The fact that the energy absorber is suspended in a freely movable manner in the plastic bag means that there is no abrasion during filling, since the kinetic energy of the polycrystalline silicon falling into the bag is converted into kinetic energy of the energy absorber, without abrasive matter thereby being produced.

During the closing, the air is preferably extracted from the bag until a vacuum of from 10 to 700 mbar is produced. A vacuum of 500 mbar is preferred.

In one embodiment, the polysilicon is first portioned and weighed before the packaging by means of the method according to the invention. In this case, the portioning and initial weighing of the crushed polysilicon material takes place by means of a manual or automatic method known from the prior art. The free choice of method means that even the high initial weighing accuracy required for crushed polysilicon material for the semiconductor industry of within no more than +/−0.6% can be achieved. The contamination of the polysilicon thereby occurring is inconsiderable, since in a preferred embodiment of the invention the contaminated polysilicon is cleaned before packaging if the contamination concerned is above the admissible limit values.

For this purpose, as stated, the crushed polysilicon material is first weighed, a portion thereof is placed in a process bowl and this is cleaned before it is introduced in these portioned units by way of a filling device with a freely suspended flexible tube of a nonmetallic low-contamination material into a likewise freely suspended, high-purity plastic bag, and the plastic bag is subsequently closed. The cleaning of the crushed polysilicon material in the process bowl takes place as known from the prior art; it preferably takes place chemically, for example as described in EP 0905 796 B1.

This variant of the packaging method according to the invention, as also described in Example 4, has a productivity that is increased by more than 100% in comparison with manual packaging (kg of Si per hour of labor) with the same quality of the packaged crushed polysilicon material.

Preferably, all the variants of the method are carried out under flow boxes, or for semiconductor material under clean room conditions of the class <100. This has the result that the method is preferably carried out by means of a carousel filling and closing machine or similar types of packaging machine, in which the filling and closing stations are not in a circular arrangement, in which the filling device is provided with a freely suspended flexible tube of a nonmetallic low-contamination material, by way of which the crushed polysilicon material falls into a high-purity, freely suspended plastic bag, for example of PE or PP. On account of the stringent purity requirements, this variant of the method is particularly suitable for the packaging of crushed polysilicon material for the electronics industry.

In the method according to the invention, commercially available high-purity plastic bags, preferably low-density (LD) PE bags, are used. After extrusion, these bags are immediately closed in a clean room of class <100 and transported in closed plastic boxes. By contrast with the method used in the patent EP 133 4907 B1, with these bags there is no risk of the inner side of the bag that is in contact with the product being contaminated with particles from the surroundings. The boxes are only opened and the device supplied with the bags in the clean room. In the device, the bags are constantly kept under clean room conditions of class <100 and, after filling with polysilicon, are closed, or preferably welded, preferably within <10 seconds.

Preferably, the bag obtained by one of the variants of the method is introduced again into a plastic bag, for example of LD-PE, with a wall thickness of from 10 to 1000 μm, and welded. This preferably takes place in turn by means of the method according to the invention, it now being the closed plastic bag filled with crushed polysilicon material that is filled into the second plastic bag instead of the crushed polysilicon material, and the second plastic bag is closed, preferably welded. The bags or double bags are subsequently packed in boxes.

By contrast, in the case of the method according to the prior art (for example EP 0905 796 B1), although automatic portioning is performed before bagging, there is no longer any cleaning of the crushed polysilicon material.

An automatic weight correction, as described for example in EP 0 905 796 B1, is also possible in the case of the method according to the invention, since, according to the invention, the polysilicon is only cleaned after the weight is corrected, and therefore the risk of contamination does not increase, unlike the situation described in EP 0 905 796 B1. Carrying out a weight correction with an accuracy of +/−30 g for a filling weight of 5000 g is possible in the case of automatic packaging with the following variants of the method:

Method 1

The filled and welded PE bags are re-weighed. If they are overweight or underweight, these few bags are removed. In the case of the bags with an incorrect initial weight, the weight is manually corrected; the polysilicon is cleaned again, if required, and decanted into a new bag and the bag is welded.

Method 2 a.) Differential weighing of the process bowl before and after emptying.

b.) In the case of a weight deviation of +/−30 g, the method automatically stops and the operator carries out a manual correction.

c.) After the weight correction, the method according to the invention continues to the filling of the PE bag.

In the experience of the inventors, action in accordance with method 2 is required approximately once for every 200 filled bags.

The invention also relates to a device for packaging crushed polycrystalline silicon material or polysilicon granules.

This device comprises a filling station and a closing station, in which a PE bag suspended on a gripper system is moved from station to station in a cyclical sequence, characterized in that the filling station comprises a freely suspended tube of a nonmetallic low-contamination material (for example plastic), which is introduced into the PE bag before the filling of the PE bag with polycrystalline silicon and is removed from the PE bag after the filling of the PE bag with polycrystalline silicon, and the filled PE bag is transported further by means of the gripper system into the closing station and is closed there.

Preferably, the welded bag is subsequently transferred by way of a gripping system or a conveyor belt to the machine part for providing the outer bag.

Preferably, the gripper system comprises two grippers and is arranged in such a way that all the parts of the gripper system are located to the side of or below the opened bag. This arrangement of the gripper system avoids contamination of the inner side of the bag.

The closing device/closing station is preferably a welding device, more preferably a heat-sealing welding device based on a heated welding wire, which is preferably coated with a nonmetallic material, for example Teflon. The closing device may, however, also be an adhesive-bonding or form-fitting device.

The modification according to the invention of a standard packaging machine known per se, by means of the short, low-contamination flexible tube freely suspended in the plastic bag, makes the packaging of sharp-edged, heavy, high-purity bulk material (polysilicon for the electronics industry) possible for the first time.

Carousel filling and closing machines or similar types of design are known in the prior art. At the filling station of the device according to the invention, the bag is opened. By way of a conveying device, which is lined with silicon or a low-contamination material and is connected to a movable flexible tube of a nonmetallic material, for example plastic, the sharp-edged crushed polysilicon material is filled through this tube into the opened PE bag.

The conveying device is, for example, a conveying channel or a chute, preferably a chute.

The tube preferably has a diameter of from 10 to 50 cm, a length of from 5 to 50 cm, a wall thickness of from 0.1 to 100 mm and an angle of inclination to the plane of the conveying device of from 1 to 120 degrees. A diameter of from 20 to 30 cm is preferred (25 cm is particularly preferred), an angle of inclination of from 80 to 100 degrees (90 degrees is particularly preferred), a length of from 10 to 20 cm (15 cm is particularly preferred) and a wall thickness of from 1 to 10 mm (5 mm is particularly preferred). The shocks caused by the polysilicon in free fall into the PE bag are absorbed by the freely movable tube in such a way that significantly less damage occurs in comparison with the bag forming, filling and sealing machine. This is the case even when filling with types of crushed polysilicon material that have an average edge length of greater than 100 mm and weights of the individual pieces of crushed polysilicon material of between 2000 and 10.000 g.

After filling, the bag filled with crushed polysilicon material is passed on to the closing station. In this station there is preferably a heat-sealing welding device, in which the metal welding wire is preferably coated with a nonmetallic material, for example Teflon. The PE bag is welded by means of the heat-sealing welding device. During this operation, the air is preferably extracted from the bag, until a vacuum of from 10 to 700 mbar is produced. A vacuum of 500 mbar is preferred.

Preferably, manual portioning and weighing take place before the packaging in the device according to the invention. The cleaning preferably takes place as described in EP 0905 796 B1.

The welded bag is preferably passed on to a second device according to the invention for providing an outer bag. On the way from device 1 to device 2, the inner bag may be lightly shaken on a conveyor belt to even out the bag.

In the second device, the welded bag filled with polysilicon is introduced into a second PE bag. At the filling station of the second device, a second PE bag is opened. The filled PE bag (inner bag) transported from the first device to the second device by way of a conveying unit, for example a gripping system, is introduced into the second bag (outer bag) by way of a gripping device.

After the inner bag has been introduced into the outer bag, the PE double bag filled with crushed polysilicon material is passed on to the closing station. In this station there is preferably a heat-sealing welding device, in which the metal welding wire is coated with a nonmetallic material, for example Teflon. The PE outer bag is then welded. During this operation, the air is preferably extracted from the bag, until a vacuum of from 10 to 700 mbar is produced. A vacuum of 500 mbar is particularly preferred.

In the device according to the invention, a shaper lying laterally against the outside of the PE bag may be used to bring the filled bag into a square, not bulging shape. After closing, a square-shaped flat bag can be introduced much more easily into a box with intermediate compartments. Easier introduction in comparison with a bulging bag minimizes the risk of an increase in the perforation rate.

The welded double bag is passed on from the grippers by way of a conveying system, for example a gripping system or a conveyor belt, to the final packaging. In final packaging, the double bag is introduced into the shipping box.

In the case of the packaging of crushed polysilicon material for the solar industry, the low quality requirements make it possible to install the two devices according to the invention in a clean room of a class >100 or other climatically controlled areas. In this case, a commercially available vertical or horizontal bag forming, filling and sealing machine may also be used instead of a device according to the invention as the second device, for providing the outer bag.

The following examples serve for further explanation of the invention.

The fragment sizes 1 to 5 that are given in the examples are fragments of polycrystalline silicon with the following properties:

| Fragment size | Average weight | Range for edge length | Average edge length |
|---|---|---|---|
| 5 | 600 g | 80-170 mm | 115 mm |
| 4 | 80 g | 40-150 mm | 75 mm |
| 3 | 5.5 g | 20-80 mm | 32 mm |
| 2 | 0.5 g | 5-45 mm | 17 mm |
| 1 | 0.1 g | 3-25 mm | 5.5 mm |

Example 1

Packaging According to the Invention

Twenty batches, each of 5 kg, of fragment sizes 5, 4, 3 and 2 were charged onto a low-contamination lined vibratory channel and within 10 seconds filled into a freely suspended high-purity PE bag by way of a freely movable plastic tube (diameter 25 cm, length 15 cm, wall thickness 5 mm, with an angle of inclination to the vibratory channel of 90 degrees), which reaches into the PE bag (32 cm wide, 45 cm long and 300μ thick). After filling, the bag was welded by a vacuum welding device with Teflon-coated welding wires under a vacuum of 500 mbar.

The filled bag was subsequently introduced manually into an outer bag and welded in the way described above. After the welding, the bags were each introduced into a shipping box. The box was subsequently closed.

To determine the perforation rate, first the box was opened and the bags removed, opened and emptied. The empty bags were each examined as follows:

Bags that were perforated were visually determined by immersion in a water bath. Bags with holes gave off air bubbles. The surface area in $mm^2$ of the holes identified in this way in each bag was determined by measuring and adding the total surface area of the holes per bag.

Furthermore, the weight of the plastic tube before and after the filling of the bags was determined. By contrast with the method according to EP A 133 4907, no abrasion was visually evident. The differential weighing of the plastic tube before and after the filling of the bags indicated plastic abrasion (=carbon abrasion) below the detection limit of 0.1 mg per 400 kg, and was consequently below the required 300 ng per kg of Si.

Example 2

Conventional Packaging

In the same way, the perforation rates were determined for a conventional, non-automatic packaging method. In the case of this method, two bags were manually inserted one in the other, subsequently manually filled, manually welded and introduced into the shipping box.

Table 3 shows a comparison of the methods according to Example 1 (according to the invention) and Example 2 (comparative example).

TABLE 3

| Perforation rate in % | | | | |
|---|---|---|---|---|
| Fragment size | Example 2 Inner bag | Example 2 Outer bag | Example 1 Inner bag | Example 1 Outer bag |
| 5 | 75 | 20 | 40 | 0 |
| 4 | 60 | 50 | 30 | 0 |
| 3 | 20 | 0 | 10 | 0 |
| 2 | 0 | 0 | 0 | 0 |
| 1 | 0 | 0 | 0 | 0 |
| Surface area of holes per bag in $mm^2$ | | | | |
| Fragment size | Example 2 Inner bag | Example 2 Outer bag | Example 1 Inner bag | Example 1 Outer bag |
| 5 | 1.5 | 0.2 | 0.4 | 0 |
| 4 | 1.1 | 0.8 | 0.7 | 0 |
| 3 | 0.2 | 0 | 0.1 | 0 |
| 2 | 0 | 0 | 0 | 0 |
| 1 | 0 | 0 | 0 | 0 |

Table 3 shows that, with the packaging method according to the invention, at least equally good values are achieved for all silicon fragment sizes, and better values are even achieved for the fragment sizes 5, 4 and 3, with respect to the perforation rate and the surface area of holes in $mm^2$ per bag, as/than with the conventional, less productive manual method. Consequently, the automatic packaging method according to the invention meets the high requirements of the electronics industry, which until now have only been achieved by manual packaging.

Example 3

Packaging without a Movable Plastic Tube

Twenty batches, each of 5 kg, of fragment sizes 5, 4, 3 and 2 were charged onto a low-contamination lined vibratory channel and within 10 seconds filled directly into a freely suspended PE double bag with the dimensions 32 cm wide, 45 cm long and 300μ thick. As a difference from Example 1, no plastic tube was used. After filling, the bags were welded by a vacuum welding device with Teflon-coated welding wires under a vacuum of 500 mbar. The perforation rate and the surface area of the holes per bag were determined in the way described in Example 1.

TABLE 4

| Perforation rate in % | | | | |
|---|---|---|---|---|
| Fragment size | Example 2 Inner bag | Example 2 Outer bag | Example 3 Inner bag | Example 3 Outer bag |
| 5 | 75 | 20 | 100 | 100 |
| 4 | 60 | 50 | 100 | 70 |
| 3 | 20 | 0 | 20 | 0 |
| 2 | 0 | 0 | 0 | 0 |
| 1 | 0 | 0 | 0 | 0 |
| Surface area of holes per bag in $mm^2$ | | | | |
| Fragment size | During production Inner bag | During production Outer bag | Test Inner bag | Test Outer bag |
| 5 | 1.5 | 0.2 | 25 | 15 |
| 4 | 1.1 | 0.8 | 5.5 | 3.5 |
| 3 | 0.2 | 0 | 0.1 | 0 |
| 2 | 0 | 0 | 0 | 0 |
| 1 | 0 | 0 | 0 | 0 |

The results show that, as a difference from the method of Example 1, the filled PE bags have a significantly higher perforation for fragment sizes 5 and 4. For fragment sizes smaller than 4, the required perforation rates can be achieved even without a movable plastic tube. For these fragment sizes, the method according to the invention makes it possible to obtain a significant increase in productivity, or a significant reduction in product contamination, in comparison with conventional packaging methods (EP 1334907/Example 4).

Example 4

Packaging of Portioned, Cleaned Crushed Polysilicon Material with a Device According to the Invention (Modified Carousel Filling and Closing Machine)

Crushed polysilicon material was manually divided into portions of 5 kg and this portioned crushed polysilicon material was chemically cleaned (as described in EP 0905796 B1). Subsequently, the cleaned crushed material was filled in a clean room by way of a movable tube of plastic into a 300 μm thick high-purity PE bag handled by a carousel filling and closing machine, and the bag was welded.

In order to assess the quality of the packaged crushed polysilicon material, the bag was opened in a clean room of class 100, six 100 g heavy fragments of Si (in Table 5 Sit to Si6) were removed and the metal surface values of these fragments were determined in the way described in U.S. Pat. No. 6,309,467 B1.

The results of the measurements, the respective mean value and the comparative values after cleaning and manual packaging (Table 1) are reproduced in Table 5.

TABLE 5

| Figures given in pptw | | | | | | | | | | | | | | | | |
|---|---|---|---|---|---|---|---|---|---|---|---|---|---|---|---|---|
| | Fe | Cr | Ni | Na | Zn | Al | Cu | Mo | Ti | W | K | Co | Mn | Ca | Mg | V |
| Si1 | 55 | 6 | 0 | 7 | 14 | 8 | 1 | 0 | 44 | 7 | 7 | 0 | 2 | 24 | 2 | 0 |
| Si2 | 12 | 6 | 0 | 5 | 12 | 6 | 0 | 0 | 12 | 8 | 3 | 0 | 2 | 16 | 3 | 1 |
| Si3 | 44 | 1 | 1 | 100 | 32 | 6 | 1 | 0 | 26 | 17 | 32 | 0 | 1 | 30 | 3 | 0 |
| Si4 | 58 | 2 | 3 | 14 | 15 | 7 | 1 | 0 | 8 | 8 | 3 | 0 | 1 | 32 | 5 | 0 |
| Si5 | 76 | 2 | 1 | 0 | 12 | 2 | 0 | 0 | 9 | 4 | 7 | 0 | 0 | 23 | 1 | 0 |
| Si6 | 15 | 2 | 0 | 5 | 22 | 5 | 1 | 0 | 22 | 19 | 12 | 0 | 1 | 10 | 6 | 0 |
| Mean | 43 | 3 | 1 | 22 | 18 | 6 | 1 | 0 | 20 | 10 | 11 | 0 | 1 | 23 | 3 | 0 |
| Tab. 1 | 50 | 20 | 10 | 100 | 20 | 30 | 10 | 10 | 100 | 20 | 100 | 5 | 20 | 100 | 100 | 5 |

Table 5 shows that the metal surface values, or the overall contamination, is not significantly increased by the method sequence according to the invention "portioning→cleaning→automatic packaging with a device according to the invention" in comparison with the manual standard packaging method (Table 1) for electronic applications, and the level of contamination as a result of the automatic packaging, or this variant of the method, must therefore lie at the level shown in Table 2.

The invention claimed is:

1. A method for packaging polycrystalline silicon, comprising filling polycrystalline silicon by a filling device into a freely suspended, completely formed bag, and closing the bag thus filled, wherein the bag consists of high-purity plastic with a wall thickness of from 10 to 1000 μm, wherein the filling device comprises a freely suspended energy absorber of a nonmetallic low-contamination material, which is introduced into the plastic bag before filling with the polycrystalline silicon and wherein at least portions of the polycrystalline silicon contact the suspended energy absorber as the polycrystalline silicon is filled into the plastic bag, and the freely suspended energy absorber is then removed from the plastic bag filled with polycrystalline silicon, and the plastic bag is closed.

2. The method of claim 1, wherein the plastic bag consists of polyethylene (PE), polyethylene terephthalate (PET) or polypropylene (PP).

3. The method of claim 1, wherein when filling with polycrystalline silicon, the bag is held by means of at least two tong-like grippers and fed by means of these grippers to a closing device.

4. The method of claim 1, wherein the filling device comprises a filling unit and the freely suspended energy absorber is connected to the filling unit.

5. The method of claim 1, wherein the freely suspended energy absorber of a nonmetallic low-contamination material has the form of a funnel, hollow body, hollow body that is partly split open laterally parallel to the longitudinal direction, a slatted screen, or a number of elongate panels, strands or rods, and comprises a textile material or a plastic.

6. The method of claim 1, wherein during closing of the bag, air is extracted from the bag until a vacuum of from 10 to 700 mbar is produced.

7. The method of claim 6, further comprising feeding the closed bag to a second bagging station and surrounding the closed bag with a second bag, wherein prior to closing of the second bag, a vacuum of 10 to 700 mbar is produced in the second bag.

8. The method of claim 1, wherein the polycrystalline silicon is portioned and weighed before packaging.

9. The method of claim 8, wherein after portioning and weighing and before packaging, the polycrystalline silicon is chemically cleaned.

10. The method of claim 1, wherein the closed plastic bag filled with polycrystalline silicon is introduced into a further plastic bag of PE with a wall thickness of from 10 to 1000 μm, and this plastic bag is closed.

11. The method of claim 1, wherein the freely suspended energy absorber comprises a plastic tube having a diameter of 10 to 50 cm, a length of 5 to 50 cm, and an angle of inclination to the plane of conveying device of 1 to 120 degrees, wherein energy from the falling of the polysilicon is absorbed by impact with the tube and movement thereof.

12. The method of claim 11, wherein the diameter is between 20 and 30 cm, the length is from 10 to 20 cm, and the angle of inclination is from 80 to 100 degrees.

13. A device for packaging crushed polycrystalline silicon material or polysilicon granules, comprising a source of polycrystalline silicon fragments, a filling and closing machine with a filling station and a closing station, in which a PE bag is suspended on a gripper system and moved from station to station in a cyclical sequence, wherein the filling station comprises a freely suspended energy absorber of a nonmetallic low-contamination material, which is introduced into the PE bag before the filling of the PE bag with polycrystalline silicon and is removed from the PE bag after the filling of the PE bag with polycrystalline silicon, and the filled PE bag is transported further by means of the gripper system into the closing station and is closed there.

14. The device of claim 13 which is a carousel.

15. The device of claim 13, wherein the closing station comprises hot wire welding with a hot wire coated with a non-contaminating coating.

16. The device of claim 13, wherein the closing station comprises a plastic welder.

* * * * *